United States Patent [19]

Iversen

[11] 4,405,876

[45] Sep. 20, 1983

[54] LIQUID COOLED ANODE X-RAY TUBES

[76] Inventor: Arthur H. Iversen, 15315 Sobey Rd., Saratoga, Calif. 95070

[21] Appl. No.: 250,275

[22] Filed: Apr. 2, 1981

[51] Int. Cl.[3] ..... H01J 35/10

[52] U.S. Cl. ..... 313/30; 378/130

[58] Field of Search ..... 313/30, 60, 55, 33; 250/419, 420; 378/130

[56] References Cited

U.S. PATENT DOCUMENTS

| | | | |
|---|---|---|---|
| 2,860,277 | 11/1958 | Iversen | 315/3.5 |
| 3,331,978 | 7/1967 | Brown et al. | 313/30 X |
| 3,546,511 | 12/1970 | Shimula | 313/60 X |
| 3,719,847 | 3/1973 | Webster | 313/330 X |
| 3,735,175 | 5/1973 | Blomgren | 313/60 |
| 3,794,872 | 2/1974 | Haas | 313/60 |
| 3,870,916 | 3/1975 | Kussel et al. | 313/60 X |
| 3,914,633 | 10/1975 | Diemer et al. | 313/32 |
| 3,959,685 | 5/1976 | Konieczynski | 313/330 |
| 4,146,815 | 3/1979 | Childeric | 313/330 |
| 4,165,472 | 8/1979 | Wittry | 313/35 |

*Primary Examiner*—Eugene R. La Roche
*Attorney, Agent, or Firm*—Michael Lechter

[57] ABSTRACT

There is disclosed a liquid cooled anode x-ray tube wherein the rotating anode is adapted for irradiation by an energy beam, and includes a heat exchange surface, said x-ray tube includes means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes at least one of: means for forming pressure gradients in said liquid having a component perpendicular to said heat exchange surface to facilitate removal of said nucleate bubbles; and means for breaking up said viscous sublayer to facilitate removal of said nucleate bubbles.

52 Claims, 13 Drawing Figures

LIQUID COOLED ANODE X-RAY TUBES

TECHNICAL FIELD

The present invention is directed to liquid cooled anode x-ray tubes, and in particular, x-ray tubes having a continuously cooled anode whereby high average power is achieved while still maintaining the high peak powers characteristic of rotating anodes.

BACKGROUND OF THE INVENTION

The need for continuous duty, high power rotating anode x-ray tubes exists in medical radiography, i.e, fluoroscopy and computerized tomography (CT), and in industrial applications such as x-ray diffraction topography and non-destructive testing.

A number of schemes have been proposed in the past to achieve continuous power output at high peak power with a rotating anode x-ray tube. These include direct liquid cooling of the anode, liquid to vapor phase cooling of the anode, as well as other techniques.

A prior art scheme for liquid cooling rotating anodes is described in the Philips Technical Review, Vol. 19, 1957/58, No. 11, pp. 314–317. The rotating anode of the Philips device constitutes a hollow cylinder with three radially running tubes through which water flows to a cavity located along the inner surface of the peripheral wall or anode strip of the hollow body. In this device, the water flows back into the hollow drive shaft through three other tubes running radially in the rotary anode. However, various disadvantages have been attributed to the Philips device. For example, U.S. Pat. No. 4,130,772 to Kussel, et al., issued December 1978, states that only relatively low speeds of rotation can be obtained with the Philips rotary device because the maximum thickness of the peripheral wall provided as the anode target member allowable for proper cooling is not sufficient to withstand the pressures in the cooling medium that arise due to centrifugal force at higher speeds of revolution. Only relatively small surface density of illumination (brightness) can be obtained with this known rotary anode, since the intensity of illumination, i.e., radiation per unit of surface, generated by a device depends upon the rate of anode revolution.

The Kussel, et al. patent describes a liquid cooled rotating anode which purports to resolve the shortcomings of the Philips device. The portion of the rotary anode cylindrical peripheral wall, whereon the electron beam strikes, is cooled with water supplied and removed, respectively, through coaxial ducts distributed by radial ducts in one end face of the rotary to a ring duct and gathered from a ring duct as the other end face through another set of radial ducts leading back to the shaft. Between the two ring ducts, the cooling medium flows through helical cooling ducts running parallel to each other and at an angle of about 15° to the edge boundaries of the cylindrical operating surface. These ducts are formed on the outside by the anode peripheral wall material itself and on the inside by a stainless steel insert.

The Kussel device, although resolving the shortcomings of the Philips device, has several problems of its own—one of them, basic. To obtain efficient heat transfer, relatively high coolant velocities are required. To achieve high coolant velocities, high pump pressures are needed. Unfortunately, the seals necessary to join stationary to rotating fluid conduits generally have short lives when subjected to such high coolant pressures and high speed anode rotation.

A more basic limitation of the Kussel et al. device arises from the use of the metal insert with grooves machined thereon to form the coolant ducts. The outermost rims of the groove walls are brazed to the anode peripheral wall. As described, the cooling ducts traverse one face of the anode to the other at a pitch angle of 15°. Therefore, the duct walls whose peripheries are brazed to the inside surface of the anode opposite the electron beam track also traverse one face of the anode to the other at the prescribed 15° angle. Therefore, the electron beam alternately travels over coolant duct and then duct wall as the anode rotates. When the electron beam is above the coolant, heat transfer is efficient, whereas when it is above the duct wall, it simulates more closely a solid metal structure, i.e., a conventional solid rotating anode. This creates a hot spot and severely limits the power handling capability because of the long heat path to the coolant. The braze alloy, used to braze the anode to the insert and which must melt well below the metals used, further limits the power densities that can be handled. The duct walls, brazed to the periphery of the anode, which provide the necessary strength to the anode shell to prevent its distortion due to centrifugal force of the coolant, become a liability in that they become a limiting factor in power handling capability.

U.S. Pat. No. 4,165,472, issued on Aug. 21, 1979, to Wittry describes a device utilizing a cooling technique typically referred to as "liquid to vapor phase cooling." In the preferred embodiment of the Wittry patent, a two-stage system is used. The first stage consists of a sealed chamber in the anode that is filled with a coolant, such as water, that removes heat by vaporizing and recondensing on another portion of the internal anode surface that is cooled by a secondary liquid cooling loop. This in turn removes the heat to a heat sink external to the x-ray tube. In general, the various embodiments described are described as wickless heat pipes. One limitation is that heat transfer is limited by the diffusion rate of the vapor phase to the cool surface. A 6 kw capability is described in terms of a 12" diameter anode rotating at 5000 rpm. Directly cooled rotating anode x-ray tubes are rated at higher powers. Kussel discloses power capability of 100 kw. A further limitation on this structure is the sealed coolant chamber. A small amount of overheating can cause excessive pressures to be built up, i.e., bearing wear slowing the rotation. If the structure does not explode, it will bulge which will throw it out of balance, thereby rapidly wearing out the bearings.

U.S. Pat. No. 3,959,685, issued on May 25, 1976 to Konieczynski discloses a method whereby the heat capacity of a conventional, solid rotating anode x-ray tube can be increased. This is accomplished by sealing slugs of high heat capacity and selected melting point metal into the anode. When the anode reaches a critical temperature, the slugs melt, absorbing more heat. Upon cooling, they re-solidify. A 20% increase in heat capacity is mentioned. The limitation of this device is that should the melted slugs overheat and create excessive pressures due to target slowdown or stoppage (frozen bearings), it truly becomes a bomb with molten metal spewing out. This makes it unacceptable for medical use. Any irregularities in resolidification of the slugs, due to small differences in cooling rates or irregular crystal formation, will cause an imbalance in the anode with resultant early bearing failure.

U.S. Pat. No. 3,719,847 issued on Mar. 6, 1973 to Webster provides a hollow anode in which a liquid metal such as sodium or lithium is confined. Heat from the electron beam is striking the cathode which causes the liquid metal to evaporate, thereby effectively increasing the heat capacity of the anode. With no means to extract the heat, cooling is by radiation as with a conventional solid anode. Should the anode overheat, due to bearing wear, etc., the confined metal vapor will build up excessive pressure and the vessel can explode with consequent danger to personnel in the vicinity.

U.S. Pat. No. 4,146,815, issued Mar. 27, 1979, to Childenc, also discloses a hollow anode filled with a liquid metal much like that disclosed in Webster. It suffers from the same limitation of retaining the characteristic of a solid anode that must cool by radiation. It also possesses the potential of exploding like a bomb should it overheat due to bearing wear caused by age or imbalance.

U.S. Pat. No. 3,735,175, issued May 22, 1973, to Blomgren, discloses a heat pipe to transmit heat from the anode to an external heat sink. Notwithstanding the efficacy of external electrostatic cooling, a heat pipe depends on the diffusion rate of the coolant vapor to the cool end for the rate of heat removal. The power densities that can be handled are relatively low. For the power levels required, a huge and impractical heat pipe would be needed, i.e., 50 kw dissipation.

U.S. Pat. No. 3,794,872, issued Feb. 26, 1974 to Haas, discloses a fixed target anode cooled by a jet of fluid. The target is mounted on a bellows such that "the target reciprocates laterally in a direction perpendicular to the axis of the tube but the target does not rotate on its own axis." As the focal spot wears out, i.e., pits, the target is moved to a new position to provide fresh target surface. In this manner, the effective life of the tube is extended considerably. The motion provided is not rotational and therefore does not increase the output power of the tube. As a fixed target tube, its power output is low.

A prior art alternative to the respective Philips and Kussel et al. approaches to dissipation of large power loads is that of Taylor as described in *Advances in X-ray Analysis*, Vol. 9, August 1965, G. R. Mallett, et al., Plenum Press, N.Y. In the Taylor design, the liquid coolant flows transverse to the direction of anode rotation and interacts with the anode in a manner known as "linear coolant flow." However, although there is a high relative velocity between the anode and coolant, the interaction is relatively inefficient and is reported by Taylor to provide only relatively low power ($7\frac{1}{2}$ kw). This stands in sharp contrast to the 100 kw attributed to the Kussel design. However, the Taylor design is not subject to performance-limiting centrifugal forces as the Philips device is, and permits the use of low pressure pumps and components.

Further description of prior art liquid cooled rotating anode x-ray tubes is found in the following articles:

G. Fournier, J. Mathieu: J. Phys. 8, 177 (1937)
R. E. Clay: Proc. Phys. Soc. (London) 46, 703 (1934)
R. E. Clay, A. Miller: J. Instr. Elect. Engs. 84, 261 (1939)
W. T. Astbury, R. D. Preston: Nature 24, 460 (1934)
Z. Nishiyama: J. Japan Met. Soc. 15,42 (1940)
V. Linnitzki, V. Gorski: Sov. Phys-Tech, Phys. 3, 220 (1936)
R. R. Wilson: Rev. Sci. Instr. 12,91 (1941)
S. Miyake, S. Hoshino: X-sen 8,45 (1954) (Japanese)
Y. Yoneda, K. Kohra, T. Futagami, M. Koga: Kyushu Univ. Engs. Dept. Rep. 27,87 (1954)
S. Kiyono, M. Kanayama, T. Konno, N. Nagashita: Technol. Rep., Tohoku Univ. XXVII, 103 (1936)
A. Taylor: J. Sci. Instr. 26,225 (1949); Rev. Sci. Instr. 27,757 (1956)
D. A. Davies: Rev. Sci. Instr. 30,488 (1959)
P. Gay, P. B. Hirsh, J. S. Thorp, J. N. Keller: Proc. Phys. Soc. (London) B64,374 (1951)
A. Muller: Proc. Roy. Soc. 117,31 (1927)
W. T. Astbury: Brit. J. Rad. 22,360 (1949)
E. A. Owen: J. Sci. Instr. 30,393 (1953)
K. J. Queisser: X-ray Optics, Applications to Solids Verlag-Springer, NY (1977), Chap. 2
Longley: Rev. Sci. Instr. 46,1 (1975)
Mayden: Conference on Microlithography, Paris, June 21–24, 1977, pp. 196–199
MacArthur: Electronics Eng. 17,1 (1944–5)
A. E. DeBarr: Brit. J. Appl. Phys. 1,305 (1950)

SUMMARY OF THE INVENTION

The present invention provides a liquid cooled rotating anode x-ray tube that possesses the high power capabilities of the Kussel type design while using low pressure pumps and components. The present invention further provides liquid cooled stationary target (anode) x-ray tubes with improved power capabilities.

The present invention also provides a high power, continuous duty liquid cooled rotating anode x-ray tube, wherein the rate of heat removal, and the critical heat flux (burn out), are increased as compared to prior art liquid cooled rotating anode x-ray tubes, and which tube is capable of long life at continuous power.

The present invention further provides for simultaneous and continuous liquid cooling of the entire heat exchange surface of a hollow rotating anode x-ray tube thereby avoiding any power limiting hot spots.

In addition, the present invention provides for a high relative velocity of the anode to coolant liquid with low fluid velocities, long lived rotational fluid seals, and permits the use of low pressure fluid pumps and components.

The present invention provides a liquid cooled stationary target (anode) x-ray tube with many of the advantages described for the liquid cooled rotating anode x-ray tube.

The foregoing is accomplished in accordance with the present invention by providing the heat exchange surface of the anode with a contoured surface, i.e., with a predetermined varying geometry, a calculated surface roughness, or both, to promote nucleate boiling and bubble removal.

DETAILED DESCRIPTION OF PREFERRED EXEMPLARY EMBODIMENTS

Figure 1:
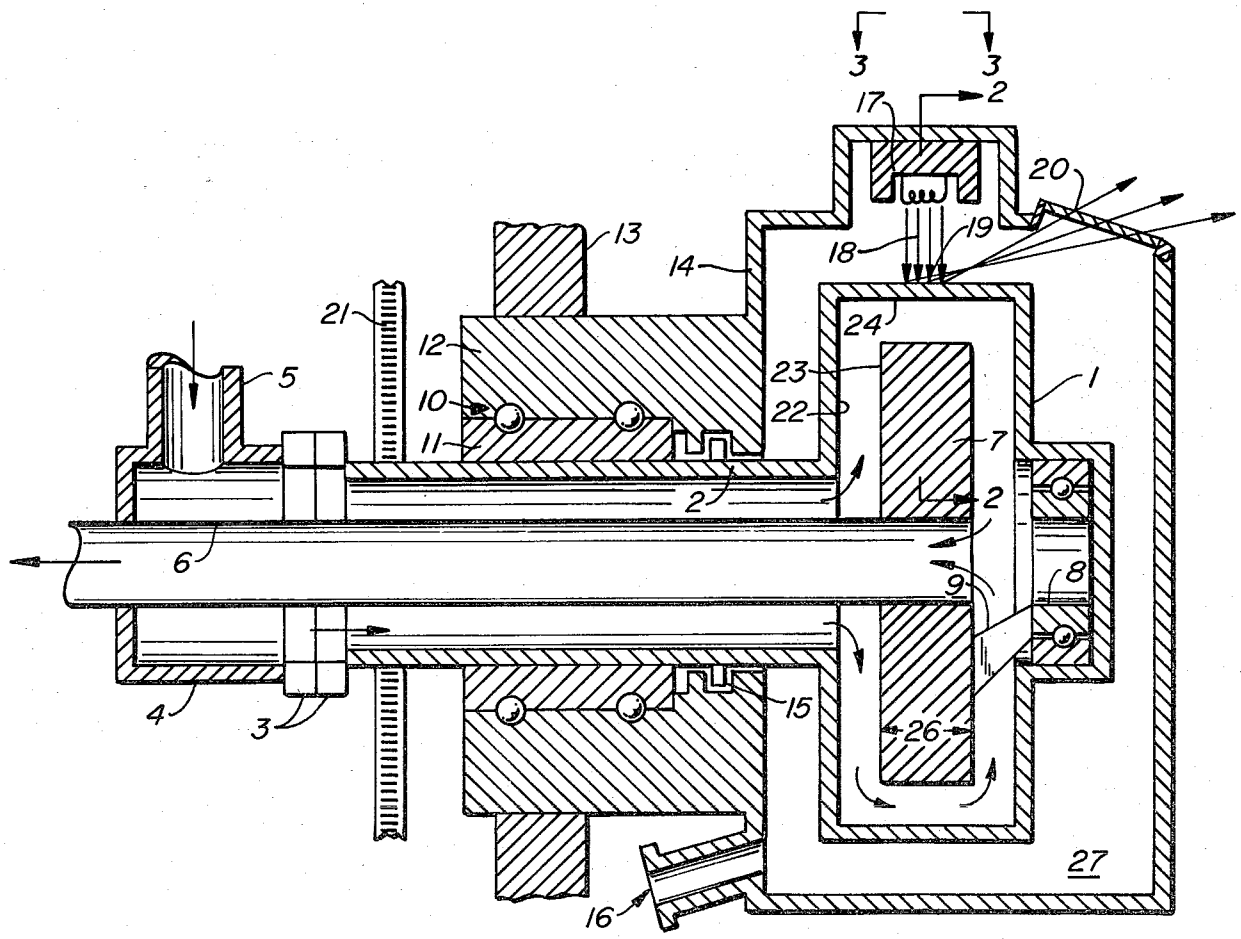
FIG. 1 is a complete cross-sectional of a rotating anode x-ray tube according to the present invention.

The basic cooling mechanism in liquid cooled anodes for use in x-ray tubes is nucleate boiling (or other vapor or gas mechanism). In nucleate boiling, bubbles of vaporized fluid are generated on the anode heat exchange surface. The vapor bubbles break away and are replaced by fresh bubbles, much like a pot of boiling water, thus providing efficient cooling by the removal of heat from the exchange surface to vaporize the liquid. In film boiling, however, the power handling capacity of the system is limited by transformation of the nucleate boiling mechanism into destructive film boiling (or other vapor or gas blanket). The heated surface is surrounded by a vapor blanket which insulates the heated surface, thus causing significantly reduced heat transfer. The primary heat removal mechanism therefore becomes radiation and convection of the vapor.

The heat flux at the transition from nucleate to film boiling is called the critical heat flux. Should this value be exceeded in electrically heated structures such as a liquid cooled x-ray tube anode, the insulating film blanket would cause a rapid rise in temperature, typically resulting in burn out (i.e., melt down) of the structure. In general, this occurs so quickly, or the protective means required are so elaborate or expensive, that adequate protection is not practical.

Formation of the boiling film occurs when expanding bubbles are generated faster than they can be carried away. The expanding nucleate bubbles interact and combine ultimately to form an insulating blanket of vapor. Thus, the transition is made from nucleate boiling to film boiling. It is the bubble interaction which controls the heat transfer process.

To provide for efficient heat removal from the liquid cooled inner surface of the anode, i.e., at the anode heat exchange surface, a high relative velocity between the anode heat exchange surface and the liquid, approximately 50 feet per second or greater, is required. The anode heat exchange surface is that surface on the inside liquid cooled surface of the hollow rotatable anode to which substantially all the heat generated by the electron beam striking the electron beam track is transmitted. The anode heat exchange surface is generally larger than the surface illuminated by the electron beam track and is also generally centered on the electron beam track.

In the prior art previously described, high pressure pumps have been used to achieve the desired high liquid velocity. Shortened rotational fluid seal life and attendant anode design limitations, previously noted, result. To obviate these design limitations, use is made in accordance with one aspect of the present invention, of the high rotational velocity present in rotating anode x-ray tubes. A state-of-the-art rotating anode tube operates at 10,000 rpm and is 4 inches in diameter. The rotation of the anode can thus provide a surface velocity at its periphery of about 170 feet per second, considerably greater than the desired minimum (50 feet per second).

Such high rotational velocity of the anode is required to achieve the high peak powers obtained in conventional rotating anode x-ray tubes. The present invention combines relatively low velocity liquid which traverses the path of anode rotation, with the high rotational velocity of the anode to establish necessary (but not sufficient) conditions for highly efficient heat removal.

As previously discussed, it is the presence of nucleate bubbles which cling tenaciously to the anode surface, their rate of formation, their interaction and their rate of removal that determine the critical heat flux, i.e., burn out, and the rate of heat removal. To raise the critical heat flux and simultaneously increase the rate of heat removal, the present invention provides means whereby nucleate bubbles are more rapidly removed. In addition, one series of embodiments provides for an increase in nucleation sites as well as optimizing their geometry and distribution. Thus, more nucleate bubbles of specified geometry and quantity are generated and removed, thereby increasing the heat flux.

The adherence of nucleate bubbles to the anode heat exchange surface is related to such factors as surface tension, viscosity, temperature, bubble size, etc. There are two basic methods for increasing their rate of removal. One approach is to create a pressure gradient in the fluid perpendicular to the anode surface. The higher the gradient, the faster the rate at which bubbles break loose. This is the principle by which the Kussel et al. device achieves a stated 100 kw output. In the Kussel et al. and Philips designs, the centrifugal force generated by the fluid as it is pumped at high velocities around the inside circumference of the anode generates high gradients. Thus, the nucleate bubbles break loose more rapidly thereby significantly increasing the heat transfer.

The work of Gambill and Greene at Oak Ridge National Laboratories (Chem. Eng. Prog. 54,10, 1958) theoretically and experimentally demonstrated that by using a vortex coolant flow in a heated tube, power dissipations 4 to 5 times greater than that possible by linear coolant flow could be achieved. The vortex flow, a helical motion of the coolant down the inside of a heated tube, generates pressure gradients normal to the tube wall by centrifugal force and, according to Gambill and Greene, provides a mechanism "of vapor transport (nucleate bubble removal) by centrifugal acceleration."

In the present invention, a gradient in the fluid is obtained by periodically varying, i.e., contouring, the inner surface geometry of the anode in the proximity of the electron beam track. That is, the anode wall thickness in the proximity of the electron beam track is varied in a periodic manner so as to generate periodic curves at the coolant interface. The anode surface at the electron beam track is circular. Thus, as the anode rotates, the liquid traversing the anode path periodically has a pressure gradient perpendicular to the anode wall generated by the changing anode wall thickness, i.e., a pumping action caused by the changing radius as measured from the axis of rotation of the anode to the liquid heat exchange surface of the anode. The inertia of the liquid being displaced at the anode surface creates the gradient. A number of geometries are available to create the desired gradient. The anode heat exchange surface with periodic curves generated thereon may be described, and will hereinafter sometimes be referred to, as a contoured surface.

The viscous or laminar sublayer—a thin layer of laminar flow adjacent to the wall of the conduit and always present in turbulent flow—provides a mechanism to further cause the nucleate bubbles to adhere more readily to the anode surface. The second method of increasing the rate of nucleate bubble removal is by breaking up this viscous or laminar sublayer. The viscous layer can be broken up by roughening the anode coolant surface. The roughened anode heat exchange surface may also be described as a contoured surface. A contoured surface is herein defined as any surface condition or geometry designed to improve heat transfer from the anode heat exchange surface to the liquid coolant. When the height of the roughening projections ranges from 0.3 times the thickness of the viscous sublayer to the sum of the thickness of the viscous sublayer and a transition zone adjacent the viscous sublayer, the sublayer is broken up. Breaking up the viscous sublayer enables the turbulent fluid to reach the base of the nucleate bubble, where it is attached to the anode, thereby providing the energy needed to break it loose.

The thickness of the viscous sublayer is a function of the Reynolds number $R_n$ (the ratio of inertia forces to viscous forces) as used in fluid mechanics. The dimensionless Reynolds number is used to characterize the type of flow in a hydraulic structure where resistance to motion is dependent upon the viscosity of the liquid in conjunction with the resisting forces of inertia, and is given by the equation:

$$R_n=(\rho/u)V(A/P)$$

wherein $\rho$=density of the fluid
u=viscosity of the fluid
V=velocity of the fluid
A=area of fluid in conduit
P=wetted perimeter of conduit
A/P=hydraulic radius Thus, for a given fluid, of specific density and viscosity, the Reynolds number defines the relationship between the fluid velocity and conduit geometry. Most efficient heat transfer is obtained with turbulent fluid flow as compared to laminar fluid flow. Turbulent fluid flow is characterized by a Reynolds number of at least 2000. However, with very rough surfaces, turbulent flow can be obtained at a Reynolds number of 1000.

The geometry of nucleate bubbles is a function of the surface roughness geometry; small fissures tend to generate small nucleate bubbles, whereas large fissures tend to generate larger ones. Therefore, nucleate bubble size and generation can be optimized by providing a surface of calculated and preferably uniform roughness and geometry. A surface having such roughness and geometry may also be considered as a contoured surface as defined above. A regular roughness geometry can be obtained by suitable conventional techniques such as, for example, chemically by means of chemical milling; electronically, by the use of lasers or electron beams; or mechanically, by broaching, hobbing, machining, milling, stamping, engraving, etc.

Another method of obtaining a surface with crevices for forming nucleate bubbles is the use of a thin porous metal layer adherent to the anode at the anode heat exchange surface. This porous metal layer may be considered to provide a contoured surface as defined above. Relatively uniform pore size can be obtained by fabricating the porous structure from metal powders with a narrow range of particle sizes. Methods, such as described in U.S. Pat. No. 3,433,632, are well suited to providing the desired porous metal structure.

Thus, optimum cooling can be obtained by combining a calculated surface roughness with generated curves on the anode cooling surface. The surface roughness generates nucleate bubbles of uniform dimensions and breaks up the viscous or laminar sublayer which causes the bubbles to adhere more readily to the anode surface. The gradient generated by the periodic curves on the anode coolant surface further assists in causing the nucleate bubbles to be rapidly carried away.

A fully roughened conduit surface induces large frictional losses in liquids with attendant pressure drop. The pressure drop is related to the length of roughened surface. In the preferred embodiment of the present invention, the roughened anode surface width, or length of the roughened surface in the direction of liquid flow, ranges from 1 to 9 times the width of the electron beam track and is generally on the order of one-quarter to two-inches wide. Thus, the pressure drop due to the roughened surface, i.e., a roughness height ranging from 30% that of the viscous sublayer thickness to approximately equal to the combined thickness of the viscous sublayer and the transition zone, is minimal. Surfaces having roughness heights less than 30% of the viscous sublayer thickness are effectively smooth. Increasing the roughness height beyond that described can result in dead spots at the base of the roughness elements. This will adversely affect the heat transfer characteristics. Increasing the spacing between roughness elements to minimize the dead spots will result in fewer nucleation sites per unit area, with consequent reduction in heat flux. In addition, the pressure drop increases with consequent increase in required pumping power. Thus, for a specified fluid, i.e., viscosity and density, optimum geometries can be specified.

In general, liquid cooled anodes such as the previously described Philips and Kussel et al. devices are characterized by conduit geometries at the heat exchange surface with long lengths and small cross sections. Contoured surfaces in such conduit geometries could result in excessive pressure drop. In contrast, one aspect of the present invention provides a heat exchange surface having a short length and a large cross section. This permits the use of fully roughened heat exchange surfaces with minimum pressure drop.

In addition, the small ratio of length (L) to diameter (D) of the conduit as compared to large L/D ratios as are present in the Kussel et al. design, results in greater heat flux, i.e., heat transfer, per unit area. The rule of thumb is that each halving of the L/D ratio increases the heat flux by 15%.

To minimize the pressure drop further and not induce significant rotational velocity to the liquid, a thin stationary sleeve can be placed in close proximity to the inside diameter of the outer rotating shaft used to impart rotation to the anode. The sleeve proceeds the full length of the shaft and flares to a funnel shape in the anode so as to retain close proximity. It terminates shortly before reaching the heat exchange surface of the anode. Thus, minimal rotational velocity is transmitted to the liquid from the outer rotating shaft. Another method to minimize induced rotational velocity in the liquid is to place thin longitudinal vanes external to the inner stationary sleeve which separates the incoming from the outgoing liquid. The vanes extend to close proximity to the inner wall of the hollow rotating shaft and continue into the anode, terminating just before the anode strip. The vanes serve to dampen any induced rotational velocity in the liquid caused by contact with the inside diameter of the outer rotational shaft.

Thus, the design criteria have now been established for optimum heat transfer in liquid cooled rotating anode x-ray tubes. They are as follows:

1. Utilize the high rotational velocity of the anode to obtain the desired high relative anode to liquid velocity.
2. Provide relatively low velocity liquid flow that traverses the path of anode rotation.
3. Maintain a Reynolds number of at least 1000 at the anode heat exchange surface.
4. In the proximity of the electron beam track, provide periodic variations in the wall thickness of the hollow rotatable anode so as to generate periodic curves at the heat exchange surface; the outer surface of the anode containing the electron beam remaining circular.
5. In the proximity of the electron beam track, provide a calculated surface roughness at the anode heat exchange with roughness projections of heights ranging from 0.3 times the thickness of the viscous sublayer to equal the sum of the thickness of the viscous sublayer and the transition zone to break up the viscous sublayer.

Using design criteria 1 and 2 alone results in a circular anode surface at the liquid interface with a smooth surface, i.e., surface roughness less than 0.3 of the thickness of the viscous sublayer. Even with the high anode to liquid velocity, poorer heat transfer and lower critical heat flux result because the nucleate bubbles will adhere more readily to the anode surface inasmuch as there is no pressure gradient generated to induce them to break away, other than those normally generated by surface tension and other minor factors, such as shear forces and transmitted turbulence. Therefore, the bubbles become larger and remain longer and have a greater tendency to interact to form the insulating vapor blanket of film boiling. Thus, poorer heat transfer and lower critical heat flux, i.e., burn out, result.

This is much like spinning a cup of water on its axis. The water remains essentially stationary while the cup spins and then slowly picks up rotational velocity. Were the inside surface of the cup contoured, i.e., roughened and/or provided with periodic curves as described, the water would agitate quickly thereby providing improved interaction with the cup wall, i.e., improved heat transfer.

The use of a gradient to provide efficient heat removal is shown by the previously-described Kussel et al. device. In that device, the liquid is pumped essentially circumferentially around the anode, i.e., at 15° to the path of anode travel. The change in direction, i.e., centrifugal force, of the liquid as it travels along the inner surface of the peripheral wall induces the desired gradient. Kussel et al. reports 100 kw with this design. The present invention will achieve the same results without the described shortcomings of the Kussel et al. design.

Referring now to FIG. 1, the basic structure of a preferred exemplary embodiment of the present invention will be described. A hollow anode 1 attaches to a hollow rotating shaft 2. A rotational fluid seal 3 is mounted at the end of hollow shaft 2. A stationary cupped cylindrical attachment 4 with entrance duct 5 is mounted to rotational fluid seal 3. A stationary tube 6 is disposed concentrically with, and extends through, stationary hollow cupped cylindrical attachment 4; a hermetic seal is provided between attachment 4 and stationary tube 6. Stationary tube 6 extends longitudinally, and concentrically, within hollow rotatable shaft 2 into the hollow rotatable anode 1. A stationary septum 7 is mounted on hollow stationary tube 6, and disposed within hollow anode 1. Hollow anode 1 is rotatably coupled to stationary septum 7 by a rotational bearing 8 and a fin radial support and centering means 9 attached to inner, stationary segment of bearing 8.

A rotatable bearing member 10, including an inner rotating segment and outer stationary segment 12 is utilized to rotatably couple rotatable shaft 2 to a mounting member 13 and to a vacuum envelope 14. Inner rotating segment 11 of rotatable bearing member 10 is fastened to the outside diameter of hollow rotatable shaft 2. Outer stationary segment 12 of rotatable bearing member 10 is fastened to mounting member 13 and a vacuum envelope 14. Suitable rotatable high vacuum sealing means 15, such as ferrofluidic seal, is incorporated in bearing 10 to vacuum seal stationary member 12 to rotatable shaft 2 to facilitate provision of a vacuum within vacuum envelope 14, surrounding anode 1. An electron gun 17 is mounted within vacuum envelope 14. Electron gun 17 provides an electron beam 18 focussed upon an electron beam track 19 on the exterior periphery of anode 1. Illumination of anode 1 by beam 18 causes generation of x-rays which exit through a vacuum tight x-ray transparent window 20 in vacuum envelope 14.

Pulley 21, or other means, is connected to a suitable motor by a belt (not shown) to provide rotational drive to shaft 2 and, thus, anode 1. A port 16 is provided in envelope 14 for attachment to means, not shown, to obtain or maintain the necessary vacuum within the evacuated space 27. The vacuum may be generated by, for example, barium, titanium, or zirconium getters or VAC-Ion, titanium sublimation, cryogenic, turbomolecular, diffusion or other vacuum pumps.

The basic structure of FIG. 1, having been described above, functions as follows. Cooled fluid from an external heat exchanger and pump assembly (not shown) is pumped into the x-ray tube through duct 5. The coolant then travels toward the anode 1 between the outer diameter of stationary inner tube 6, and the inner diameter of rotatable hollow shaft 2. The coolant then passes along inside input face 22 of anode 1 and outside of input face 23 of septum 7, until it reaches the anode heat exchange surface 24.

Specific designs for the rapid removal of nucleate bubbles are applied to the anode heat exchange surface 24. The aforementioned periodic curves and calculated surface roughening are provided only on an area of the anode heat exchange surface 24 generally centered directly below the electron beam track 19 and are typically 1 to 9 times the width or greater (depending on focal spot size and anode wall thickness) of the electron beam track 19.

The septum 7 serves to direct the entire coolant flow into close proximity to the anode heat exchange surface by providing a narrow channel between the septum 7 and anode heat exchange surface 24. The width of the septum 26 is typically greater than the width of the electron beam track and is generally centered with the electron beam track. The spacing between the septum and the anode heat exchange surface is designed to maintain optimum flow and heat exchange conditions. The geometry is always such that the entire heat exchange surface of the anode, i.e., the generated curves and/or the roughened surface, is simultaneously and continuously exposed to coolant flow. In this manner, the entire heat exchange surface is continuously cooled and hot spots cannot develop due to interrupted coolant availability. Thus, optimum heat transfer is obtained and maintained.

Having passed over the anode heat exchange surface 24 to 25, the heated coolant now passes the outboard faces of the anode inside surface and septum, past support fins 9 and out through the inside of stationary tube 6. From there, the coolant proceeds to the external heat exchanger pump (not shown) and back to the x-ray tube.

It is desirable that the temperature rise at the rotatable vacuum seal 15 be minimized. The ferrofluidic vacuum sealing fluids have viscosity and vapor pressure characteristics that are very sensitive to temperature with the typical maximum operating temperature being 50° C. Accordingly, the cooled liquid is passed between the outer diameter of inner tube 6 and the inner diameter of rotatable shaft 2. This passes cooled input liquid against the vacuum seal, to maintain minimum temperatures and thus optimize operating conditions. Reversing the direction of flow would pass heated liquid next to the vacuum seal, raising the temperature of the seal. The increased seal temperature tends to cause degradation of operating characteristics, such as reducing permissible operating rpm and degrades the vacuum due to the increased vapor pressure of the heated ferrofluids. However, with a suitable cooling and insulating scheme for the vacuum seal, the coolant flow direction could be reversed which has advantages with respect to minimizing induced rotational velocity in the liquid flow.

Figure 2:
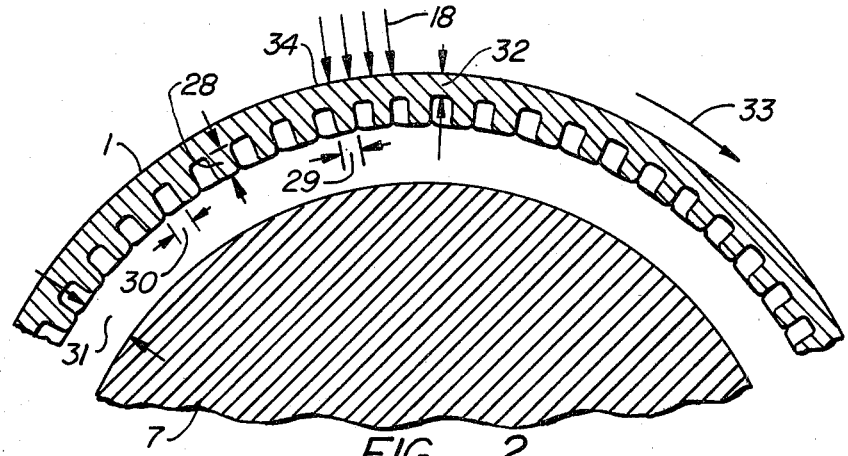
FIG. 2 is a partial cross-sectional view of rotating anode heat exchange surface illustrating roughened surface.
Figure 4:
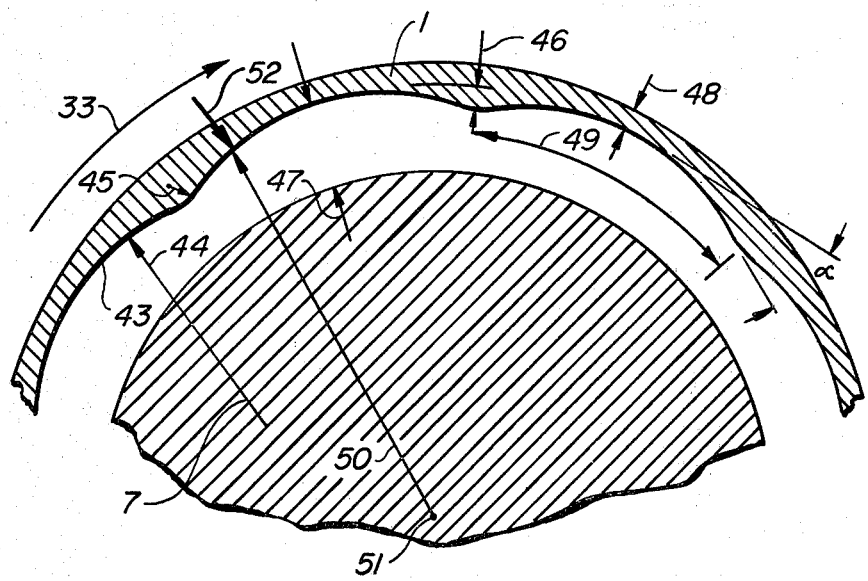
FIG. 4 is a partial cross-sectional view of rotating anode heat exchange surface, illustrating flutes with rounded cusps.
Figure 5:
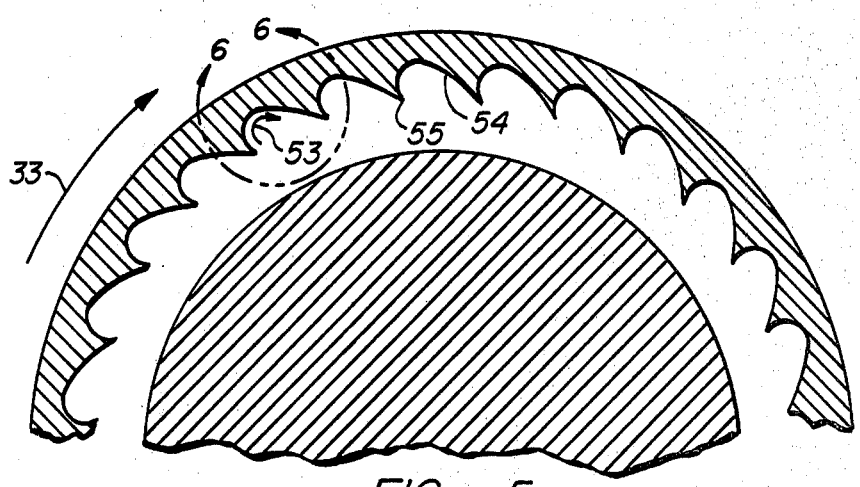
FIG. 5 is a partial cross-sectional view of rotating anode heat exchange surface illustrating flutes with cusp tips "rolled" over in the direction of anode rotation so as to induce swirl flow conditions.

Respective alternative cross sections along view 3—3 in FIG. 1 are shown in FIGS. 2, 4 and 5 to illustrate examples of contoured surface geometries that serve to increase heat flux and raise the critical heat flux at the anode heat exchange surface. The contoured surface portions of the heat exchange surface are generally centered beneath the electron beam track and range in widths from 1 to 9 times (or greater for small focal spots) that of the electron beam track. The width is dictated by parameters such as anode thermal conductivity and wall thickness, heat exchange surface geometry and coolant characteristics. In general, the septum is stationary while the anode rotates to minimize induced rotational velocity in the coolant flow.

Figure 3:
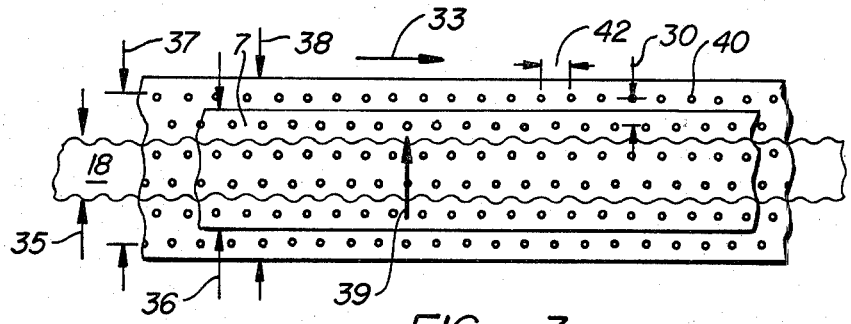
FIG. 3 is a partial vertical view of rotating anode heat exchange surface, illustrating a roughened surface.

FIGS. 2 and 3 illustrate a contoured surface comprising a roughened surface at the anode heat exchange surface as shown in FIG. 2. Roughness projections having height, width and spacing generally indicated as 28, 29 and 30, respectively, are provided on the heat exchange surface of the anode 1. The projections are in alignment with septum 7, spaced from septum 7 by a distance generally indicated as 31. Height 28, width 29 and spacing 30, as well as septum 7, anode 1, spacing 31 and anode wall thickness 32, are designed to provide optimum heat transfer. Anode rotation 33 and the electron beam 18 striking the anode strip 34 are shown.

Referring now to FIG. 3, the widths of electron beam 18, septum 7, the contoured portion of the heat exchange surface and face are generally indicated as 35, 36, 37 and 38, respectively. Septum width 36 and roughness width 37 are generally equal to or greater than the electron beam track width 35. Electron beam track width 35 is less than the anode face width 38 for all cases. The roughness width 37 is generally greater than the septum width 36. Liquid flow, generally indicated as 39 (FIG. 3) passes between septum 7 and anode 1 (FIG. 2), traversing the path of anode rotation 33 (FIG. 3). The direction of liquid flow 39 is shown 90° (normal) to anode rotation 33. However, in any of the heat exchange configurations, the liquid flow vector 39 can be rotated to provide a velocity component with or against the direction of anode rotation to further optimize heat transfer. Roughness elements (projections) 40 are spaced along the direction of coolant flow at a distance generally indicated as 42. Roughness element 40, spacings 30 and 42, as well as height 28 (FIG. 2) and shape, are designed to provide optimum heat transfer based on parameters such as fluid viscosity, density, boiling characteristics, thermal characteristics and geometry of the anode, electron beam power densities, etc. Once the benefits of break-up of the viscous sublayer are achieved, further increase in roughess element height generally reduces the efficiency of heat transfer by increasing the possibility of dead spots at the roughness base between roughness elements and increasing the thermal impedance of the roughness element.

An alternative contoured surface is shown in FIG. 4, using periodic curves in the shape of flutes, with rounded cusps. Flutes 43 of radius 44 and rounded cusp radius 45 are provided on the inside surface of anode 1. Flute height and period are generally indicated as 46 and 49, respectively. Flute height 46, flute radius 44, cusp radius 45 and flute period 49 are designed for optimum heat transfer for a given liquid, anode metal, power density, anode rotational velocity, etc. The maximum angle $\alpha$ formed by the rounded cusp is 20°, with minmum break-up in liquid flow occurring at 7°.

Anode rotation in the direction indicated by arrow 33 provides the high relative anode to liquid velocity required for generating a pressure gradient at the anode surface. The changing radius 50, generated by the flute as measured from the axis of rotation of the anode 51, causes inward displacement of the fluid inducing in the liquid a radial inward force 52 along the radius of the flute. It is this force, i.e., an artificial gravity, that generates the pressure gradient that assists in more rapidly breaking loose and carrying away the nucleate bubbles. Rounding the cusps to radius 45 minimizes eddies and break-up of the liquid flow as it passes over the cusps, thus maintaining efficient heat transfer.

Figure 6:
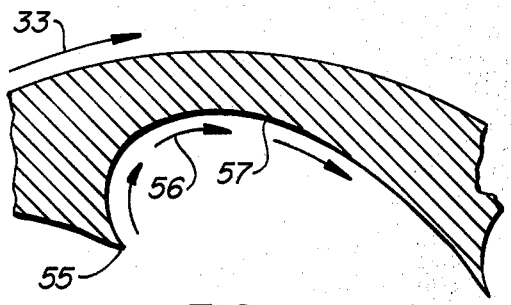
FIG. 6 is an enlarged view of a single flute as depicted in FIG. 5.

A further alternative contoured surface is shown in FIG. 5, using a geometry that induces swirl flow, generally indicated as 53, of the coolant along the surface of the anode. The geometry uses a modified flute shape 54, wherein the cusp tip 55 is "rolled" over in the direction of anode rotation 33. An enlarged breakout is shown in FIG. 6. As the liquid traverses the path of anode rotation 33, it is "scooped" up by rolled-over cusp tip 55. The centrifugal force generated by the liquid as it flows (indicated by arrow 56 (rapidly along the curved surface 57 creates a gradient perpendicular to the anode heat exchange surface that more readily breaks loose nucleate bubbles. The efficiency of the swirl flow configuration may be enhanced by angling the swirl flow structure with respect to the path of anode rotation. FIGS. 5 and 6 depict the swirl flow structure normal to the plane of rotation 33 of the anode.

Figure 7:
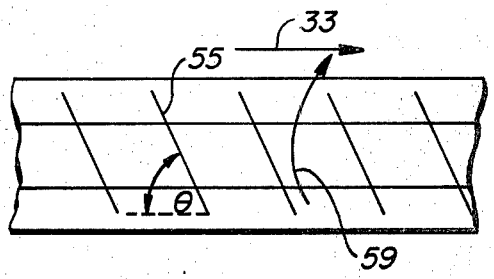
FIG. 7 is a partial vertical view of rotating anode heat exchange surface illustrating flutes and "rolled" cusps angled at other than 90° to direction of anode rotation.

FIG. 7 schematically illustrates a contoured surface wherein the swirl flow structure is placed at an angle $\theta$ with the path of rotation 33 of the anode. Angling the swirl flow geometry serves to provide a component of velocity in the direction of liquid flow thereby minimizing back pressure generated by vaporized liquid or other causes. In so doing, it maintains optimum swirl flow conditions. The path of the swirl flow is represented by arrow 59.

To enhance further the interaction of the liquid with the anode heat exchange surface, the spacing between the septum and the anode may either converge or diverge in the direction of liquid flow or may be a complex curve which combines both convergence and divergence. This geometry serves to optimize further the local liquid flow characteristics in the region of the heat exchange surface. An example of such a structure is shown in FIG. 8.

Figure 8:
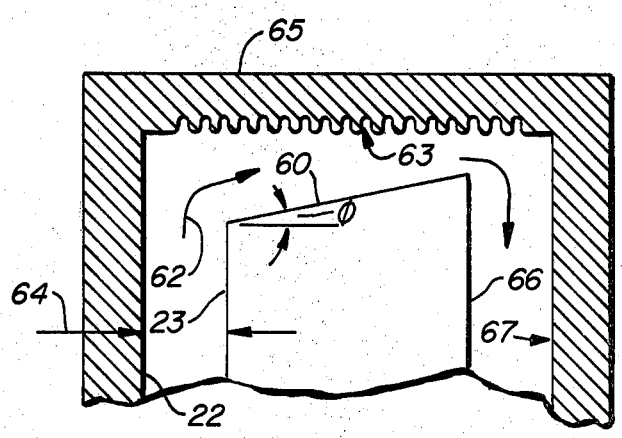
FIG. 8 is a partial cross-sectional view of rotating anode heat exchange surface illustrating a converging spacing, in the direction of fluid flow, between anode and septum, with the septum geometry varying and the anode heat exchange geometry remaining fixed.

FIG. 8 illustrates a converging geometry in the fluid conduit at the heat exchange region wherein the septum face 60 is angled at angle $\phi$ in the direction of liquid flow 62. The geometry of the septum face 60 may also diverge or be a complex curve containing both converging and diverging elements, i.e., a concave or convex arc. The geometry shown illustrates a modified septum. In some cases, it may be desirable to modify the geometry of the anode heat exchange surface 63 in like manner. An example would be the embodiment depicted in FIG. 5 wherein the swirl flow geometry could be enhanced by a diverging anode geometry which would use a component of centrifugal force to optimize further the swirl flow characteristics. Additional improvement may be obtained by designing for optimum spacing geometry between inside anode input face 22 and septum input face 23, generally indicated as 64. To maintain constant liquid velocity, a constant cross section is required. Thus, input face spacing 64 would decrease as liquid flow 62 approached the anode strip 65. In general, spacing geometry between the output faces of the septum 66 and anode 67 is not critical to the heat exchange process and may be optimized for parameters such as strength or minimizing back pressure.

Referring again to FIG. 1, a further design consideration (raised by passing the cooled coolant between inner tube 6 and outer rotatable shaft 2) is the undesirable rotationable velocity in the direction of anode rotation imparted to a thin layer of coolant adjacent the inside diameter of the rotatable shaft 2 as it travels toward the anode and up the anode face 22.

Figure 9:
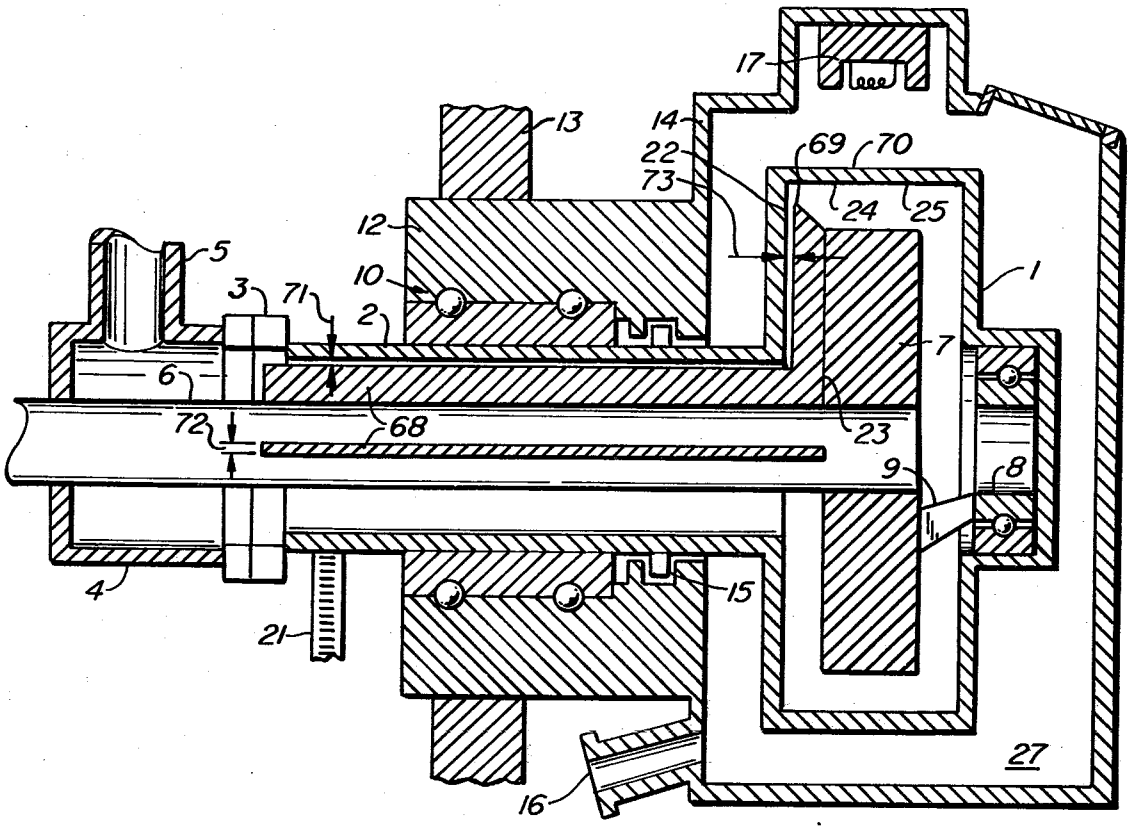
FIG. 9 is a complete cross-sectional view of a rotating anode x-ray tube incorporating baffle fins in the coolant input conduit so as to minimize induced rotational velocity in coolant flow.

Only a thin layer of liquid has a rotational velocity imparted to it, and it substantially mixes with the main body of flow. Thus, only a minor rotation of the total liquid stream by the time it reaches the anode surface is created. However, this rotational velocity is undesirable because it reduces the relative velocity between the anode and the coolant. A coolant rotational velocity can be minimized by two structures. The first, as illustrated in FIG. 9, utilizes thin fins 68 mounted longitudinally on the outer diameter of inner tube 6. Fins 68 extend from rotatable coolant seal 3 to a point at 69 just before anode heat exchange surface 70. Fins 68 are maintained in close proximity (a distance generally indicated as 71) to the inner diameter of rotatable shaft 2, and in close proximity (a distance generally indicated as 73) of inner anode face 22.

Figure 10:
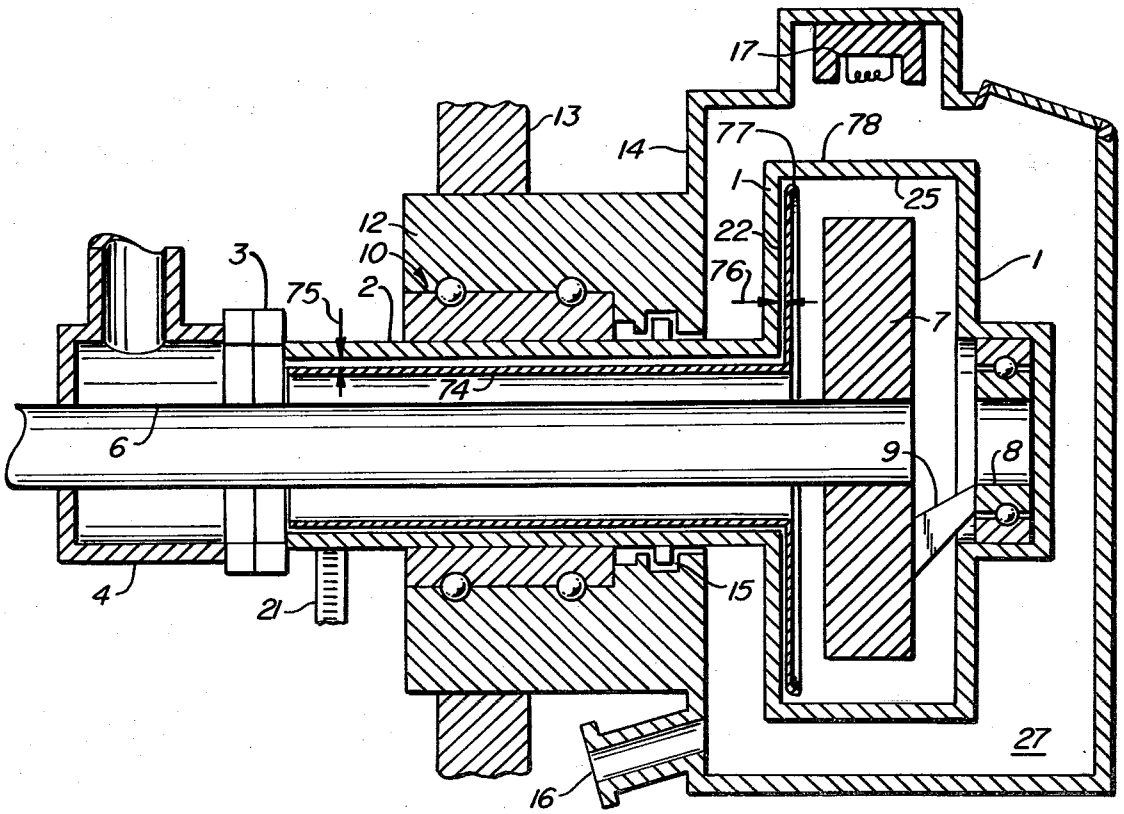
FIG. 10 is a complete cross-sectional view of a rotating anode x-ray tube incorporating a stationary outer tube so as to minimize induced rotational velocity in coolant flow.

A second method of minimizing induced rotational flow in the coolant (shown in FIG. 10) is by providing a thin walled stationary outer tube 74, extending from the rotatable coolant seal 3 into the anode 1, in close proximity (a distance generally indicated as 75) to the inner diameter of rotatable shaft 2, and maintaining close proximity (distance generally indicated as 76) to anode face 22, terminating at point 77 just prior to anode strip 78. (The radial support fins are not shown.)

Thus, in both structures, the incoming cooled coolant is substantially separated from rotationally-induced motion imparted by rotational shaft 2 and anode face 22, or rotational components are damped out. Once past the heated anode surface, induced rotational velocity in the coolant is no longer relevant to the heat exchange process. To further isolate thermally the incoming coolant from the outgoing heated coolant, inner stationary tube 6 (FIG. 1) may be constructed from two thin walled tubes. These two tubes, whose diameters are such to provide a small gap between them, are concentrically and hermetically brazed at each end in a vacuum. Thus, the evacuated space between the tubes provides insulation as with a "thermos" jug.

Figure 11:
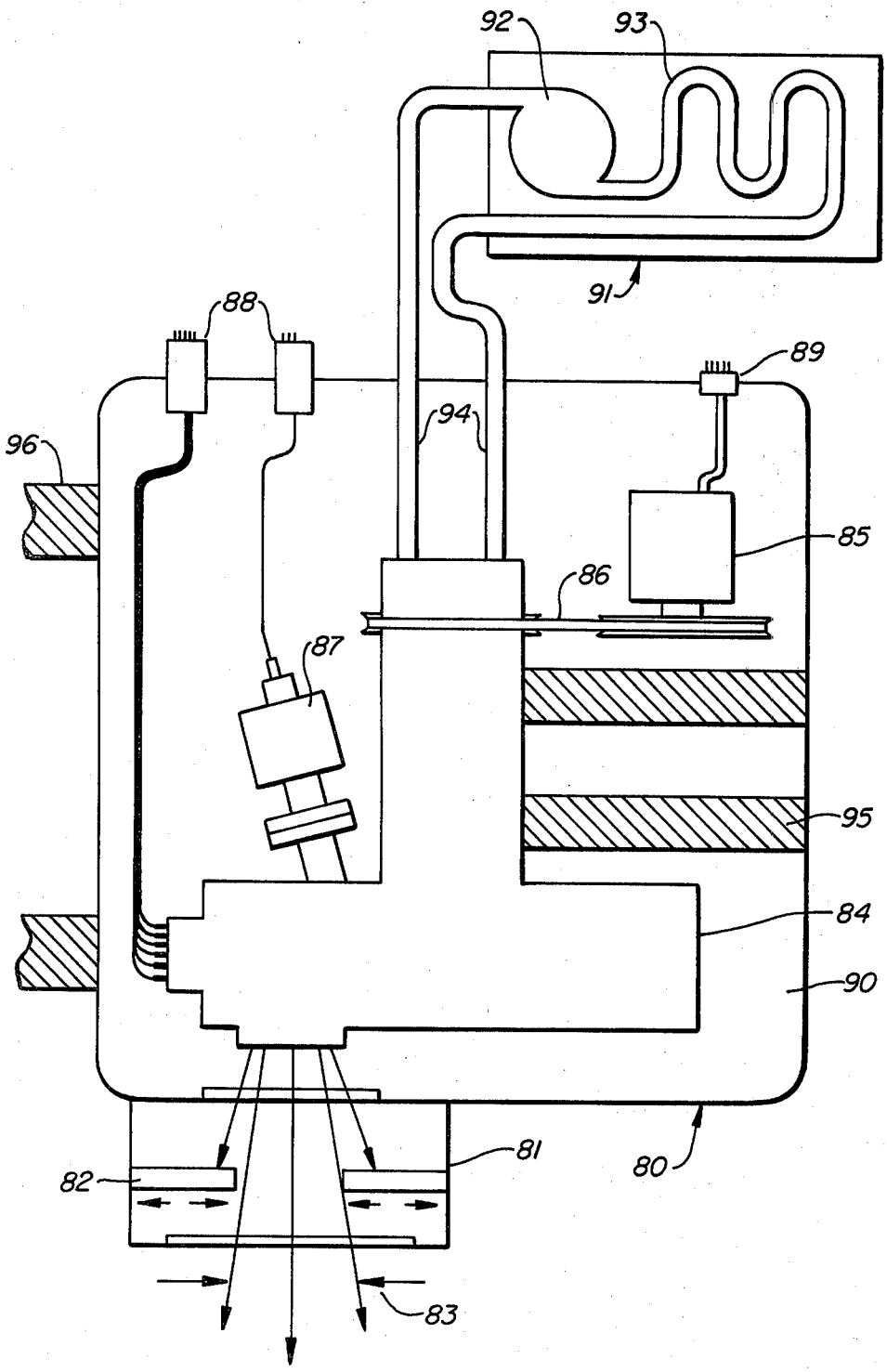
FIG. 11 is an x-ray tube assembly containing the essential elements that are required for the functioning and use of a liquid cooled rotating anode x-ray tube.

The liquid cooled rotation anode x-ray tube is mounted within an x-ray tube assembly. Such an x-ray tube assembly, shown in FIG. 11, typically comprises the following elements: an x-ray tube housing 80 which is generally made from an x-ray absorbing material; an x-ray beam limiting device 81, commonly called a collimator; a liquid cooled rotating anode x-ray tube 84, as previously described; a motor 85 and a drive belt 86, or other means for rotating the anode at the desired rpm. Collimator 81 may contain movable shutters 82 to permit a variable x-ray field size 83 to be obtained. A vacuum pump 87 is mounted on or within the x-ray tube vacuum envelope to maintain the required vacuum. Vacuum pumping means that may be used include, for example, getters or Vac-Ion, titanium sublimation, cryogenic, diffusion or turbomolecular pumps. These pumps may be used alone or in combination. High 88 and low 89 voltage cables and connectors are utilized as required. A suitable high voltage isolation medium 90 is required within the x-ray tube housing 80 to prevent arc-over from high voltage surfaces on the x-ray tube to the grounded housing. A suitable medium 90 may be a gas such as a freon or sulphur hexafluoride or a liquid such as a fluorocarbon, a silicone oil or a transformer oil. A vacuum may also be used as an insulating medium or selected regions may be potted with solid dielectrics such as epoxy or silicone. The above illustrative insulating means may be used alone or in combination. A heat exchanger 31 is required if the coolant system is to be of the closed loop type. Generally, the heat exchanger contains a pump 92 for circulating the coolant fluid and heat exchange means 93 to transfer the heat to a secondary medium. The secondary medium is suitably air for an air-cooled system and water for a water-cooled system. Suitable couplings and hoses 94 are utilized if the heat exchanger is external to the x-ray tube assembly.

Mounting elements 95 for the x-ray tube within the x-ray tube housing are also provided. These mounting elements are suitably formed of dielectric materials such as ceramic or plastic for high voltage isolation. External mounting means 96 are also provided for mounting the x-ray tube assembly in the desired systems configuration.

It should be appreciated that the foregoing describes a particularly advantageous liquid cooled rotating anode x-ray tube and the assembly which is suitable for use in applications that require the continuous duty generation of x-rays at high power levels. This includes high voltage x-rays for medical diagnostic use or low voltage x-rays for applications such as lithography.

The contoured surface techniques herein described can be applied to other geometrics of rotating anode and fixed target tubes. For example, to provide for efficient cooling of the heat exchange surface of the anode, the heat exchange surface is contoured such that the liquid flow interacting with the contoured surface generates a pressure gradient perpendicular to the anode heat exchange surface. Alternatively, a calculated surface roughness (geometry) may be applied to the liquid cooled anode heat exchange surface as previously described for the liquid cooled rotating target x-ray tube. Both techniques may be used. The applications of the design criteria can best be illustrated by reference to an example.

Maldonado et al., J. Vac. Sci. Technol., 16 (6) November/December 1979, describe a stationary target (hereinafter called an anode) x-ray tube. The anode is described as a cone with a wall thickness of 0.6 mm and is provided with a water diverter to provide uniform average water velocity on the back (outside) surface of the cone. A flow of water approaches the cone tip substantially parallel to the central axis of the cone. Constant conduit cross section and resulting constant velocity of the water is obtained by varying the spacing between the back of the cone and the water diverter. A pressure drop of approximately 85 psi is required to obtain the stated velocity of $10^4$ cm/sec (330 ft/sec) along the heat exchange surface of the anode. This very high velocity is required to obtain efficient heat transfer, i.e., the rapid removal of nucleate bubbles under the conditions of substantially linear flow.

In this example, a flow of 4 gal/min is used for 4 kw input power (though less than 1% of the water actually boils, i.e., 2 gal/sec). The high power dissipation, 12 kw/cm$^2$, is achieved by the use of the very high velocity cooling water along the anode surface coupled with the initial pressure gradient perpendicular to the anode surface, generated at the cone tip region, and progressing some distance up the side, by the water flow as it is diverted outwardly by the cone geometry. Though little water boils, a high Reynolds number is required to obtain a high cooling efficiency. It can be seen that the change in direction, i.e., divergence, of the water flow as it strikes the tip of the cone and the continuing divergence of different layers of water some distance up the surface of the cone will create a pressure gradient perpendicular to the anode heat exchange surface due to inertia forces.

This is the same principle, but different structure, as the previously described Kussel et al. and Philips devices. However, at some point past the tip of the cone, the path of the water flow becomes substantially linear along the surface of the cone, i.e., no further pressure gradients of substance are generated perpendicular to the surface of the anode heat exchange surface. At this point, the maximum heat flux becomes determined by the linear coolant flow characteristics. The higher heat flux possible in the region where a gradient is present cannot be utilized, thus the transition from a flow wherein a pressure gradient perpendicular to the heated surface has been established to one where the flow is linear, i.e., a perpendicular gradient is no longer present, as occurs in the described conical anode, limits the maximum heat flux (burn out) to the lowest value determined by the linear coolant flow.

Maximum heat flux can be obtained from the conical anode in accordance with one aspect of the present invention by providing the outside surface of the cone along the heat exchange region in the form of a diverging curve. The constantly changing path of coolant flow generates a pressure gradient perpendicular to the anode heat exchange surface thereby maximizing heat flux. The curve suitably is in a shape similar to a Tractrix, Hypocycloid, ellipse, or some other curve that generates similar shapes, rotated about the Y axis as shown in Granville et al., *Elements of Calculus,* Ginn & Co., 1946, pp. 528, 532. The shape of the water diverter would also change from a conical surface to a curved one in order to maintain the constant cross section. Such an anode target assembly is shown in FIG 12.

Figure 12:
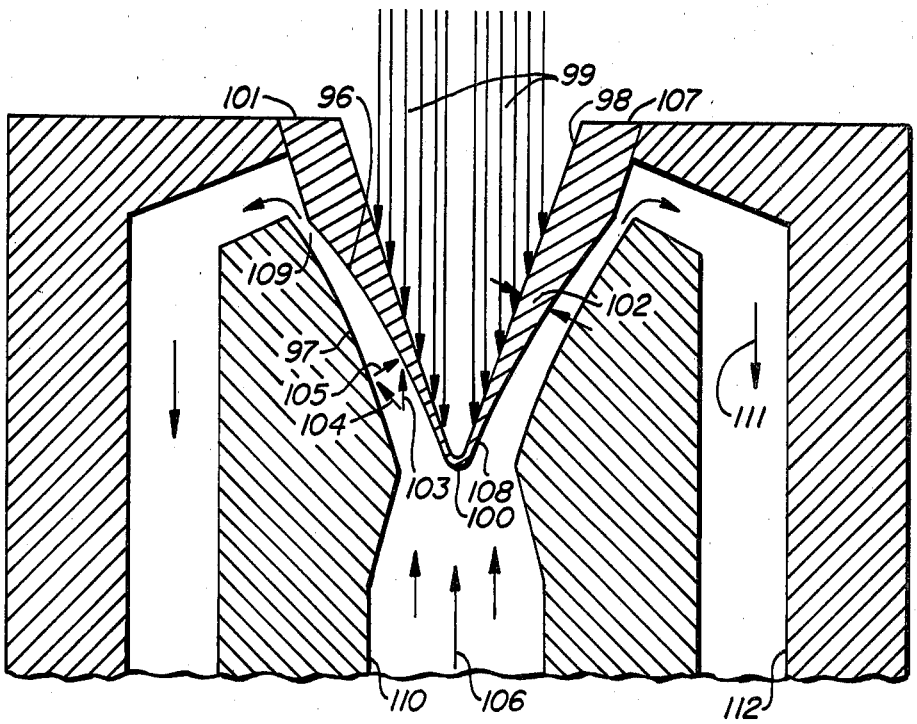
FIG. 12 is a cross-sectional view of a stationary anode utilizing the present invention.

Referring now to FIG. 12, the conical outside surface of the anode is replaced with a curved surface 96. The shape of the water diverter 97 is also curved and in such manner as to maintain the constant conduit cross section specified by Maldonado et al. The inner surface 98 of the anode remains cone shaped to maintain a constant electron beam 99 power density striking the anode surface. The hollow circular electron beam 99 described by Maldonado et al. is shown. The conical inner surface 98 and the curved diverging outer surface 96 of the anode result in an increasing anode wall thickness 102 as one progresses from the apex 100 to the base 101 of the "cone". If it were desired to obtain a uniform anode wall thickness, the inner surface 98 of the anode would conform in shape, i.e., curvature, to the outer curve 96. Vector 103 illustrates the direction of water flow, already somewhat outwardly diverged from its initial path. Vector component 104 shows the velocity component tangent to the curved anode heat exchange surface. It is velocity component 105 that creates the pressure gradient perpendicular to the anode surface. The gradient may be increased by increasing the rate of curvature of anode surface 96 or by increasing the velocity of the liquid coolant 106. The $10^4$ cm/sec water velocity described by Maldonado et al. is very high and therefore only a small curvature of the anode surface 96 is required to generate an appreciable gradient. The anode heat exchange surface is the surface of the portion of anode 107 beginning slightly above the apex 108 of the anode and within the diverter, to just before the end of the diverter at point 109 on the anode surface towards the base of the anode 107. The diverter structure 110 serves to separate incoming water 106 from outgoing water 111 as well as to provide the proper conduit geometry in the anode heat exchange region. The anode holder 112 forms the outer jacket for the exiting water 111.

Electron beam power density considerations may dictate that the inside surface, i.e., vacuum side, of the cone remain a simple conical geometry. The outside surface, i.e., the water cooled anode heat exchange surface, is provided with the diverging curve. Therefore, the stated anode wall thickness, 0.6 mm, must vary in some manner. For example, the wall thickness at the cone tip may start thinner, i.e., as thin as 0.25 mm (0.010") and then get progressively thicker to some maximum thickness, possibly about 1 mm (0.040") towards the base of the cone. The minimum and maximum permissible wall thickness will be dictated by the properties of the anode metal, coolant conduit geometry, characteristics of the coolant liquid and its velocity, desired power densities, etc. Inasmuch as the described conical anode is already quite efficient from a heat exchange standpoint, and this is principally due to the very high water velocity, i.e., high Reynolds number, the improvements from the present invention may reside more from the reduced probability of destructive film boiling, alluded to in the article, and/or a reduced pressure required, presently 165 psi, rather than for any increased power that may be realized. Alternatively, it may enable the use of a dielectric coolant, such as a fluorocarbon or a silicone oil, instead of water. This eliminates the corrosion problems associated with water and, more importantly, enables the anode to operate at high voltage which permits designs which substantially eliminate the destructive heating effects of secondary electrons on the x-ray window and other parts of the tube.

In this type of structure, the x-ray window and selected regions of the vacuum envelope would operate at ground potential, the cathode assembly would be above ground potential, and the anode would operate at the desired potential above the cathode. Thus, the target window and other heat sensitive x-ray tube elements operating at ground potential would reflect secondary and reflected primary electrons thereby avoiding any heating due to this effect. This simplifies tube design and construction by eliminating shields, etc., as well as enhancing tube life and/or performance.

To further improve the heat exchange characteristics of the conical structure, the liquid cooled anode heat exchange surface can be provided with a calculated surface roughness with a roughness height not less than 0.3 times the thickness of the viscous or laminar sublayer, nor greater than the combined thickness of the viscous sublayer and the transition zone. The conical target described makes use of high velocity water flow in a narrow height conduit. Roughening the water cooled anode heat exchange surface would increase the pressure drop across the anode heat exchange region from the present 85 psi to some higher figure depending upon surface roughness geometry. There may be adequate pressure already available with the described design. Optimum heat exchange characteristics can be obtained by combining the described contoured anode surface with the above surface roughness geometry.

The present invention can also be used advantageously in conjunction with the anode geometrics designed to provide uniform field intensity. The need for an x-ray field of uniform intensity is most pronounced in x-ray lithography, the emerging technique for use in the manufacture of future generation semi-conductors. To obtain maximum x-ray intensity, the electron beam generally is projected as a line source on the target and the target is viewed at a shallow angle above the target plane. Though this provides maximum intensity with smallest apparent focal spot, it suffers from the disadvantage that there is a rapid variation in x-ray intensity with change in viewing angle. A geometry that significantly reduces this problem and yet retains the advantage of maximum x-ray beam intensity by virtue of a shallow angle focal spot projection is the use of a conical target in a stationary target x-ray tube. By projecting a beam inside a conical surface, a relatively uniform field intensity can be achieved over a reasonable field size for use in lithography. As one proceeds off axis, as the field intensity drops from one side of the cone because of the smaller angle relative to the target surface, however, the field intensity is substantially compensated for by an increase in intensity from the opposite side of the cone where the angle is increasing.

This technique, while only valid for small changes in angle, is quite effective. A geometry that would partially accomplish the same effect for a rotating anode would be to provide a "V" groove in the anode corresponding to the electron beam track. Thus, along an axis at right angles to the groove, an effect similar to that of the conical shape of the fixed target would be achieved. As the intensity is measured off axis from the center of the groove, the opposite surface would tend to compensate for the decrease due to a smaller target angle. However, along an axis parallel to the groove, compensation would be substantially absent.

Figure 13:
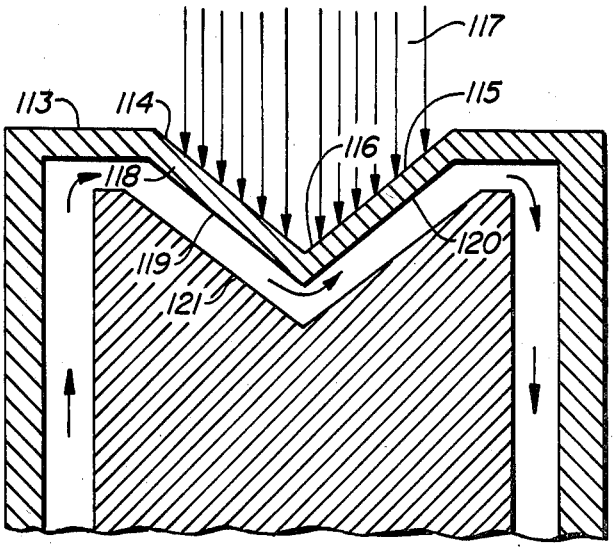
FIG. 13 is a cross-sectional view of a high power uniform intensity x-ray tube utilizing the present invention.

FIG. 13 illustrates a "V" groove rotating anode configuration. The rotating anode 113 has a "V" groove 114 machined along its periphery. The vacuum side of the "V" groove 114 provides the inclined surface for the electron beam track 115. The apex 116 of the "V" groove is not irradiated by the electron beam 117 because of poorer heat transfer characteristics. While anode wall 118 is shown having a uniform thickness, the anode wall thickness 118 can be made variable to optimize heat transfer. The liquid cooled anode heat exchange surface on the incoming face 119 and the outgoing face 120 of the "V" groove is provided with a contoured surface or a calculated surface roughness, or a combination of a contoured surface and a calculated surface roughness. Incoming liquid cooled "V" groove surface 119 may have a different contoured surface or calculated surface roughness, or combination thereof, than that on outgoing liquid cooled "V" groove surface 120 to further optimize performance. Septum 12 is contoured with respect to the liquid cooled side of the "V" groove so as to provide the desired conduit geometry.

It will be understood that the above description is of preferred exemplary embodiments of the present invention and that the invention is not limited to the specific forms shown. Modification may be made in the design and arrangement of the elements without departing from the spirit of the invention as expressed in the appended claims.

I claim:

1. In x-ray generating apparatus of the type including a rotating anode adapted for irradiation by an energy beam, and including a heat exchange surface on the interior surface thereof, said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes:

means, disposed on said heat exchange surface, for forming nucleate bubbles or predetermined size and distribution to thereby increase heat flux.

2. In the apparatus of claim 1 the further improvement wherein said means for the efficient formation of nucleate bubbles comprises cavities of predetermined geometry and distribution created in said anode heat exchange surface, said cavities being spaced apart such that at maximum power dissipation the nucleate bubbles formed at said cavities do not coalesce to form an insulating vapor blanket.

3. An apparatus as described in claim 1 wherein said means for forming pressure gradients comprises periodic variations in the anode wall thickness of said hollow rotatable anode in the proximity of said electron beam track, said wall thickness variations generating periodic curves at the anode heat exchange surface.

4. In apparatus of the type including an anode adapted for irradiation by an energy beam, and including a heat exchange surface, said apparatus including means for providing a flow of coolant liquid to remove heat from said heat exchange surface by formation of nucleate vapor bubbles on and removal from said heat exchange surface, said liquid tending to include a viscous sublayer adjacent to said heat exchange surface, the improvement wherein said heat exchange surface includes means disposed thereon for breaking up said viscous sublayer to promote removal of said nucleate bubbles.

5. In the apparatus of claim 4, the further improvement wherein the apparatus comprises means for generating pressure gradients in said liquid having a component perpendicular to said heat exchange surface without substantially impeding the relative velocity between the anode heat exchange surface and said liquid, said component having a magnitude directly proportional to the square of relative velocity between said anode heat exchange surface and said liquid.

6. In apparatus of the type including an anode adapted for irradiation by an energy beam along a first portion thereof, and including a heat exchange surface generally underlying and at least generally coextensive with said anode first portion, said apparatus includes means for providing a flow of coolant liquid to remove heat from said heat exchange surface by formation of nucleate vapor bubbles on said heat exchange surface and removal of said nucleate bubbles from said heat exchange surface, the improvement wherein:

said apparatus includes means for generating pressure gradients in said liquid having a component perpendicular to said heat exchange surface along substantially the entirety of said heat exchange surface without substantially impeding the square of relative velocity between the anode heat exchange surface and said liquid, said component having a magnitude directly proportional to the square of relative velocity between said anode heat exchange surface and said liquid, to promote removal of said nucleate vapor bubbles from said heat exchange surface.

7. In the apparatus of claim 6 wherein said liquid tends to include a viscous sublayer adjacent to said heat exchange surface, the further improvement wherein said heat exchange surface includes means for breaking up said viscous sublayer.

8. In apparatus of claim 1, 4, 5 or 7 the further improvement wherein said anode heat exchange surface has intimately adherent thereto a thin porous metal layer.

9. In the apparatus of claim 8 the further improvement wherein said porous metal layer is of relatively uniform pore size.

10. In the apparatus of claim 5, 6, or 7, the improvement wherein said means for generating pressure gradients comprises a contoured heat exchange surface having a predetermined continuous periodic geometry.

11. In x-ray generating apparatus of the type including a rotating anode adapted for irradiation by an energy beam, and including a heat exchange surface on the interior surface thereof, said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes:

means, disposed on said heat exchange surface, for breaking up said viscous sublayer to facilitate removal of said nucleate bubbles.

12. In apparatus of claim 11, the further improvement wherein said anode heat exchange surface has intimately adherent thereto a thin porous metal layer.

13. An apparatus as described in claim 11 wherein said means for forming pressure gradients comprises periodic variations in the anode wall thickness of said hollow rotatable anode in the proximity of said electron beam track, said wall thickness variations generating periodic curves at the anode heat exchange surface.

14. In the apparatus of claim 11, 4, 5 or 7 the improvement wherein said means for breaking up said viscous sublayer comprises roughness elements formed on said heat exchange surface projecting into said liquid.

15. The apparatus of claim 14 wherein said viscous sublayer is of a first predetermined thickness, and said liquid includes a transitional sublayer of a second predetermined thickness adjacent to said viscous sublayer, the improvement wherein said roughness elements project into said liquid one or more distances ranging from 0.3 times said first predetermined distance to the sum of said first and second distances.

16. In the apparatus of claim 4 the further improvement wherein said roughness elements on the anode heat exchange surface are of predetermined geometry to provide an optimum formation of nucleate bubbles.

17. In the apparatus of claim 5, 6 or 7, the improvement wherein said means for generating pressure gradients comprises said heat exchange surface and said heat exchange surface comprises a contoured surface having a predetermined periodic geometry.

18. In the apparatus of claim 17 wherein said predetermined periodic geometry comprises flutes with rounded cusps.

19. An apparatus as described in claim 18 wherein the radius of said cusps is in the range of $\frac{1}{8}$ to $\frac{1}{2}$ of the radius of said flutes, the height of said radiused cusps varying from 1 mm to 9 mm above the bottom of said flute and the wall thickness of the said anode as measured from the bottom of the flute varying from 0.2 mm to about 5 mm with the maximum angle of the flute being about 20°.

20. In the apparatus of claim 17 wherein said predetermined geometry comprises flutes with cusp tips rolled over in a predetermined direction to induce swirl flow in said liquid.

21. In the apparatus of claim 17 the further improvement wherein said predetermined periodic geometry is disposed at an angle on said anode heat exchange surface relative to the axis of anode rotation to impart to the liquid coolant a component of velocity toward the discharge side of the anode.

22. In the apparatus of claim 21 the further improvement herein the anode heat exchange surface diverges towards the discharge side of the anode whereby a further component of velocity due to centrifugal force is imparted to the liquid coolant toward the discharge side of the anode.

23. A liquid cooled rotating anode x-ray generating apparatus comprising:

a vacuum envelope including a vacuum tight x-ray transparent window;

a hollow anode, rotatably mounted within said vacuum envelope;

an electron gun, mounted within said vacuum envelope and electrically isolated from said anode, for generating an electron beam, said electron beam irradiating a circular electron beam track about the outer surface of said anode as said anode rotates;

means for providing a flow of coolant liquid to the interior of said hollow anode, said means including a conduit formed in part by the interior surface of said anode corresponding to said electron beam track;

said corresponding interior surface providing a heat exchange surface generally coextensive with said electron beam path, whereby heat is removed from said anode through formation of nucleate vapor bubbles on said heat exchange surface, said heat exchange surface being of a predetermined contoured geometry to facilitate removal of said nucleate bubbles from said heat exchange surface, said contoured geometry comprising streamlined periodic curves for generating pressure gradients in said liquid having a component perpendicular to said heat exchange surface, without substantially impeding the relative velocity between the anode heat exchange surface and said liquid, said component having a magnitude directly proportional to the square of the relative velocity between said anode heat exchange surface and said liquid.

24. The apparatus of claim 23 wherein said anode comprises:

a hollow shaft rotatably mounted on said envelope and a generally cylindrical portion mounted on said anode shaft portion, the electron beam path being disposed about the circular outer wall of said cylindrical portion, and wherein said means for providing a flow of coolant liquid comprises;

an interior hollow shaft coaxially disposed within said anode shaft portion and extending into said anode cylindrical portion; and a septum mounted on said interior shaft within said anode cylindrical portion, and generally conforming in shape to the interior of said anode, said anode, interior shaft and septum cooperating to form said conduit, whereby a first coolant path system is formed between said anode shaft and said interior shaft, a second coolant path segment is formed between the interior walls of said anode cylindrical portion and said septum, and a third coolant path segment is formed within said hollow interior shaft.

25. A liquid cooled rotating anode x-ray tube as described in claim 24 further comprising thin longitudinal vanes mounted externally to said interior hollow shaft, said vanes extending to close proximity of the interior wall of said anode shaft and continuing into the hollow anode, and remaining in close proximity to the rotating anode until terminating just prior to said anode heat exchange surface.

26. The apparatus of claim 24 wherein said anode cylindrical portion includes a V shaped portion extending into said cylindrical portion interior, said V shaped portion being disposed to receive said electron beam.

27. The apparatus of claim 23 wherein said coolant liquid in at least the portion of said conduit formed in part by said interior surface of said anode corresponding to said electron beam path exhibits a Reynolds number of at least about 1000.

28. Apparatus as described in claim 23 wherein said liquid coolant includes viscous and transition sublayers in proximity to said heat exchange surface and wherein both the outer surface and the inner surface of said hollow rotatable anode, at the electron beam track and anode heat exchange surfaces respectively, are circular, and wherein said anode heat exchange surface is prepared with a calculated roughness having projecting elements of such a height that at the operating Reynolds number the height of said surface roughness is no less than 0.3 times the thickness of the viscous sublayer and no greater than the combined thickness of said viscous sublayer and the transition zone.

29. Apparatus as described in claim 23 wherein said coolant liquid comprises a liquid selected from the set consisting of polar liquids, dielectric liquids and liquid metals.

30. A liquid cooled rotating anode x-ray tube as described in claim 23 wherein the outer anode surface is provided with a "V" groove, the width of the vacuum side of the "V" groove being at least that of the electron beam track; the inner surface of said wall corresponding to said "V" groove comprising said anode heat exchange surface, both sides of the liquid cooled surface corresponding to the "V" grooves being prepared with a contoured surface; and said tube further comprises a septum having a predetermined geometry in the vicinity of the liquid cooled surface of the "V" groove to provide a conduit of predetermined geometry.

31. The liquid cooled rotating anode x-ray tube of claim 30 wherein said anode wall thickness in the vicinity of the "V" groove is variable.

32. The liquid cooled rotating anode x-ray tube of claim 30 wherein the sides of the liquid cooled surface corresponding to the "V" grooves are further prepared with a surface of calculated roughness.

33. The apparatus of claim 23 wherein said anode comprises a hollow shaft rotatably mounted on said envelope and a generally cylindrical portion mounted on said anode shaft portion the electron beam path being disposed about the circular outer wall of said cylindrical portion, and wherein said means for providing a flow of coolant liquid comprises an interior hollow shaft coaxially disposed within said anode shaft portion and extending into said anode cylindrical portion; and a septum mounted on said interior shaft within said anode cylindrical portion, and generally conforming in shape to the interior of said anode, interior shaft and septum cooperating to form said conduit, whereby a first coolant path system if formed between said anode shaft and said interior shaft, a second coolant path segment is formed between the interior walls of said anode cylindrical portion and said septum, and a third coolant path segment is formed within said hollow interior shaft, the improvement wherein a thin walled tube mounted externally to said interior hollow shaft, said tube being in close proximity to the interior wall of said anode shaft and continuing into the hollow anode, and remaining in close proximity to the rotating anode until terminating just prior to said anode heat exchange surface whereby rotationally induced motion in said coolant liquid is minimized.

34. A liquid cooled rotating anode x-ray tube as described in claim 23 wherein the outer anode surface is provided with a "V" groove, the width of the vacuum side of the "V" groove being at least that of the electron beam track; the inner surface of said wall corresponding to said "V" groove comprising said anode heat exchange surface, both sides of the liquid cooled surface corresponding to the "V" grooves being prepared with a surface of calculated roughness, said tube further comprising a septum having a predetermined geometry in the vicinity of the liquid cooled surface of the "V" groove to provide a conduit of predetermined geometry.

35. The liquid cooled rotating anode x-ray tube of claim 34 wherein said anode wall thickness in the vicinity of the "V" groove is variable.

36. In x-ray generating apparatus of the type including a rotating anode adapted for irradiation by an energy beam, and including a heat exchange surface on the interior surface thereof, said apparatus including means for providing a flow of coolant liquid to remove heat from said heat exchange surface by formation of nucleate vapor bubbles on said heat exchange surface, said liquid tending to include a viscous sublayer adjacent to said heat exchange surface, the improvement wherein said heat exchange surface includes:

means, disposed on said heat exchange surface, for forming pressure gradients in said liquid having a component perpendicular to said heat exchange surface without substantially impeding the relative velocity between the anode heat exchange surface and said liquid, said component having a magnitude directly proportional to the square of relative velocity between said anode heat exchange surface and said liquid, to facilitate removal of said nucleate bubbles.

37. An apparatus as described in claim 36 wherein said means for forming pressure gradients comprises periodic variations in the anode wall thickness of said hollow rotatable anode in the proximity of said electron beam track, said wall thickness variations generating periodic curves at the anode heat exchange surface.

38. An anode as described in claim 37 wherein the periodic curves are flutes with rounded cusps, said rounding of cusps blending with the flutes, the radius of said cusps being from $\frac{1}{8}$ to $\frac{1}{2}$ that of the flute radius, the height of the radiused cusps varying from 1 mm to 9 mm above the bottom of the flute, and the wall thickness of said anode, as measured from the bottom of the flute, varying from 0.2 mm to 5 mm with the maximum angle generated by said flute being about 20°.

39. Apparatus as described in claim 37 wherein said periodic curves are of such a shape as to comprise means for inducing a swirl flow of the liquid against said anode heat exchange surface.

40. Apparatus as described in claim 39 wherein said periodic curves are in the shape of flutes having their cusps curved in the direction of anode rotation.

41. Apparatus as described in claim 40 wherein the conduit spacing between said anode heat exchange surface and said septum converges in the direction of fluid flow.

42. Apparatus as described in claim 40 wherein the conduit spacing between said anode heat exchange surface and said septum diverges in the direction of fluid flow.

43. In apparatus of claim 36, the further improvement wherein said anode heat exchange surface has intimately adherent thereto a thin porous metal layer.

44. A hollow rotatable anode as described in claim 37, 38 or 39 wherein said liquid coolant includes viscous and transition sublayers in the proximity of said heat exchange surface, said periodic curves being further prepared with a calculated roughness, said calculated roughness including projections of a height no less than 0.3 thickness of the viscous or laminar sublayer and no greater than the combined thickness of the viscous sublayer and the transition zone.

45. Apparatus as described in claim 37 or 40 wherein the conduit spacing between said anode heat exchange surface and said septum converges in a direction substantially at 90° to the path of anode rotation toward the discharge side of the anode.

46. Apparatus as described in claim 37 or 40 wherein said anode heat exchange surface diverges in the direction of substantially 90° to the path of anode rotation toward the discharge side of anode thereby providing a component of velocity to the liquid toward the discharge side of the anode by centrifugal force.

47. Apparatus as described in claim 37 or 40 wherein said conduit spacing, between said anode heat exchange surface and said septum, is characterized by a complex curve, said complex curve being either said anode heat exchange surface or said septum surface, or both, the curve defined by the intersection of the anode heat exchange surface and a plane parallel to, and passing through, the axis of rotation being constructed so that the fluid motion tangent to said curve, and substantially at 90° to the path of anode rotation will generate pressure gradients perpendicular to the heat exchange surface.

48. Apparatus as described in claim 37 or 40 wherein the entire anode heat exchange surface is simultaneously exposed to the coolant fluid.

49. In the apparatus of claim 38 or 40 the further improvement wherein said flutes with radiused cusps and said flutes with cusps rolled over in the direction of anode rotation are disposed at an angle to the axis of rotation of the anode whereby a component of velocity is induced in the liquid coolant toward the discharge side of the anode.

50. In the apparatus of claims 36, 6, 23 or 37 the further improvement wherein said means for forming pressure gradients in said liquid includes means for inducing a component of velocity in said coolant liquid towards the discharge side of the anode.

51. In a liquid cooled rotating anode apparatus of the type including a vacuum envelope, a hollow anode rotatably mounted within said envelope means for generating an energy beam for irradiating a circular track on said anode as said anode rotates, and means for providing a flow of coolant liquid to the interior of said anode, the improvement wherein said anode comprises:

a first hollow shaft rotatably mounted to said envelope after the axis of anode rotation;

a hollow cylindrical anode axially mounted within said envelope on the end of said first hollow shaft, said anode including a circular outer wall having a "V" groove about the periphery thereof, said groove being disposed for irradiation by said energy beam;

a second hollow shaft coaxially mounted within said first shaft, and extending into the interior of said cylinder a generally cylindrical septum member, mounted on said second shaft within said cylinder, said first and second shafts, said cylinder and said septum cooperating to form a coolant path traversing the direction of anode rotation having a first segment between the interior of said first shaft and exterior of said second shaft, a second segment between the interior of said cylinder and said septum and a third segment comprising the interior of said second shaft, whereby high relative coolant velocity is established within the anode by the rotation of said anode.

52. In apparatus of the type including an anode adapted for irradiation by an energy beam along a first portion thereof, and including a heat exchange surface generally underlying and at least generally coextensive with said anode first portion, said apparatus includes means for providing a flow of coolant liquid to remove heat from said heat exchange surface by formation of nucleate vapor bubbles on said heat exchange surface and removal of said nucleate bubbles from said heat exchange surface, the improvement wherein:

said heat exchange surface includes cavities of predetermined dimensions and distribution on said heat exchange surface whereby nucleate bubbles of a predetermined range of sizes, frequency and distribution emanate from said cavities.

* * * * *